US005663736A

United States Patent [19]

Webb et al.

[11] Patent Number: 5,663,736

[45] Date of Patent: Sep. 2, 1997

[54] MULTI-ELEMENT TRUE TIME DELAY SHIFTER FOR MICROWAVE BEAMSTEERING AND BEAMFORMING

[75] Inventors: Lance L. Webb, Hermosa Beach; John H. Hong, Moorpark, both of Calif.

[73] Assignee: Rockwell International Corporation, Seal Beach, Calif.

[21] Appl. No.: 359,268

[22] Filed: Dec. 19, 1994

[51] Int. Cl.[6] ..... H01Q 3/22

[52] U.S. Cl. ..... 342/375; 324/76.37; 250/227.12; 349/65

[58] Field of Search ..... 342/375; 359/298, 359/39, 42; 324/76.37, 76.35; 250/227.12, 201.9

[56] References Cited

U.S. PATENT DOCUMENTS

| | | | |
|---|---|---|---|
| 4,739,334 | 4/1988 | Soref | 342/368 |
| 5,012,254 | 4/1991 | Thompson | 342/373 |
| 5,231,405 | 7/1993 | Riza | 342/375 |
| 5,345,444 | 9/1994 | Clooman et al. | 370/60 |
| 5,440,654 | 8/1995 | Lambert | 385/17 |
| 5,448,417 | 9/1995 | Adams | 359/859 |

OTHER PUBLICATIONS

"A 1550–nm Millimeter–Wave Photodetector with a Bank-width–Efficiency Product of 2.4 THz", D. Wake, Journal of Lightwave Technology, vol. 10, No.7 Jul.1992.

"Phased Array Antennas", Edited by Dr. Arthur A. Oliner & Dr. G. H. Knittel—Bandwidth Criteria for Phased Array Antennas, J. Frank; Array Signal Bandwidth pp. 243–253.

"Antenna Theory and Design", Robert S. Elliott, Prentice–Hall, Inc. Englewood Cliffs, New Jersey 07632.

"Ultra–Wideband Microwave Beamforming Technique", Leo Cardone, Microwave Journal, Apr. 1985.

"The First Demonstration of an Optically Steered Microwave Phased Array Antenna Using True–Time–Delay", W. Ng et al., Journal of Lightwave Technology, vol. 9, No. 9, Sep. 1991.

"Phased Array Antennas", edited by Dr. A. Oliner & Dr. G. Knittel—Survey of Time–Delay Beam Steering Techniques, R. Tang, Phased–Array Antennas, pp. 254–260.

"Circular Arrays", D.E.N. Davies, The Handbook of Antenna Design, vol. 1 and 2, Editors A. W. Rudge, K. Milne, A. D. Olver, P. Knight.

*Primary Examiner*—Thomas H. Tarcza
*Assistant Examiner*—Dao L. Phan
*Attorney, Agent, or Firm*—Lawrence N. Ginsberg; Charles T. Silberberg

[57] ABSTRACT

In a broad aspect the present invention comprises a multiple element, multi-throw electronic switch for a fiber optical cable network. The multiple element, multi-throw electronic switch includes a bulk media optical deflector angularly controllable by selectable electronic steering signals. At least one multiple element, multi-throw electronic switch is use to construct a true time delay shifter using rows of a plurality of columns of a plurality of beamsteering optical fiber delay lines, all with a specified antenna scanning coherence center.

Distributed beamsteering is performed by selecting from the composite array, subarrays for which a common steering direction cosine can be applied to that subarray. The distributed beamforming is performed by combining elements beamsteered with a common antenna scanning coherence center from an electronically small core fibers with limited available modes into larger core multimode fibers. The distributed beamsteering and distributed beamforming is iterated until all antenna elements in the composite array have been beamsteered into an array with the identical specified antenna scanning coherence center.

The bulk media optical deflector angularly controllable by selectable electronic steering signals has the additional advantage that a plurality of squint-free antenna beamsteering commands can be simultaneously implemented providing a frequency-independent means of antenna beam shaping which necessary for a frequency-independent monopulse processing capability.

9 Claims, 5 Drawing Sheets

MULTI-ELEMENT TRUE TIME DELAY SHIFTER FOR MICROWAVE BEAMSTEERING AND BEAMFORMING

STATEMENT OF GOVERNMEMT INTEREST

The government has rights in this invention pursuant to a contract with the United States Air Force.

BACKGROUND OF THE INVENTION

1. Field of the Invention

The present invention relates to bulk devices and electronic scanning or switching techniques for efficiently steering antenna beams for transmission and reception of microwave and millimeter wave frequencies, and more particularly to squint-free electronic beam steering for antenna systems with a large aperture "fill-up time" or large gain-bandwidth product.

2. Description of the Related Art

Phased array antennas have numerous advantages in the transmission and reception of signals for radar, communication, and free space data links. Electronic scanning of one or more simultaneous antenna beams is an implied property of the modem phased array antenna system. True electronic scanning means no physical movement by the antenna or any of its component parts to accomplish almost instantaneous movement of the antenna beam upon command.

The installation ease is the first special advantage of no mechanical movement. Instead of a large radome housing the antenna of a ground radar, the phased array antenna can be incorporated into the roof and sides of buildings. Instead of a small dish antenna surrounded by a 2-axis or 3-axis mechanical gimbal and its required angular rotation clearance space consuming the entire nose of an aircraft a flush-mounted array could be incorporated into the skin of an aircraft. Instead of placing a mechanically complex unfurlable reflector antenna and its positioner on a spacecraft, a phased array antenna allows mechanically simple, fixed, compact structural panel with a scanning beam without a gimbal.

Near instantaneous, inertialless electronic movement of the antenna beam is the second special advantage of the phased array antenna. This near instantaneous electronic movement of the antenna beam is especially useful for maneuvering aircraft maintaining multiple communication links with a remote locations or multiple nearby maneuvering aircraft. This same advantage is also useful for airborne radar in performing ground mapping, terrain avoidance, obstacle avoidance, and SAR imaging while maneuvering.

Ultra low sidelobe antenna patterns producible by a phased array antenna are a significant performance advantage for radar clutter reduction, interference reduction, and reduction in vulnerability to jammers. In a related category is the phased array's ability to steer antenna pattern nulls towards the origin of interfering or jamming signals. These important features give the radar or communication link dramatically improved figure of merit in the rejection of clutter and man-made interference.

Current technology is rapidly producing the ability to use extremely wideband signal waveforms, such as Wake, D., "A 1550-nm Millimeter-Wave Photodetector with a Bandwidth-Efficiency Product of 2.4 THz," Journal of Lightwave Tech., Vol. 10, No. 9, July 1992, 908–912. The use of these extremely wideband signal waveforms gives the opportunity of emission security and frequency reuse as well as performing functions requiring increased data rates.

The gain-bandwidth product limitation of a phase-only steered phased array antenna is most easily characterized by beam squint. Beam squint is the movement of the phase-only steered main antenna beam towards its only potentially wideband coherent antenna beam position, usually broadside as the frequency increases. Frank, J., "Bandwidth Criteria for Phased Array Antennas," Phased-Array Antennas, Oliner, Arthur A., and Knittel, George H., Editors, Artech House, Inc., Dedham, Mass. 1972. p 243–253 calculates the bandwidth of this effect by frequencies for which the beam response has degraded by 3 dB. from the peak. This bandwidth can also be related to the "Fill-up" time or time duration of a pulse necessary to simultaneously illuminate the entire antenna aperture by an incident pulse from a worst case direction. Failure to simultaneously illuminate the entire antenna aperture, prevents a phase-only steered array from achieving its full coherent gain.

Squint-free beamsteering is achieved by replacing phase steering with true time delay (TTD) steering together with a dispersionless beamforming network (BFN). At the antenna beam centers of squint-free beamsteering, the TTD beamsteering devices will introduce no frequency distortions on the signals. The scanning array control for TTD beamsteering is very similar in form to the standard array formulas, such as Elliott, Robert S., Antenna Theory and Design, Prentice-Hall, Inc., Englewood Cliffs, N.J., 1981, p128 by the uniform progressive steering phase factor, $\alpha_z$, in the array factor $A_a(\theta)$:

$$A_a(\theta) = \sum_{n=0}^{N} (I_n/I_0)\, w^n$$

where:

$I_n$ is the amplitude of array element n=0,1, . . . ,N $w=\exp[j(kd\cos\theta-\alpha_z)]$, $\theta$ is the polar angle of the linear array k is the free space propagation constant, d is the array lattice distance between elements.

It can be shown that the above summation formula may be expanded and generalized using progressive true time delay steering instead of phase steering and the complex frequency, s, to:

$$A_a(z)=[I_N/I_0][z^N+(I_{n-1}/I_N)z^{N-1}+\ldots+(I_1/I_N)z+I_0/I_N]$$

where: $z=\exp[s(d\cos\theta-f_z)/c]$, $s=\sigma+j\omega$=complex frequency, c=velocity of light, $f_z$=progressive true time delay steering factor.

In the $A_a(z)$ array factor form, the z variable satisfies the time delay variable of the z-transform. By constructing beamsteering true time delay lines for each array element according to this formula, the antenna scanning coherence center of this array is located at the coherence center of the $I_0$ array element. Similarly, by constructing the beamsteering true time delay lines for $z^{-N}A_a(z)$, the antenna scanning coherence center of this array is located at the coherence center of the $I_N$ array element.

There are several microsecond-speed photonic approaches in the literature for overcoming phase only steering: Discrete beam positions, and hybrid phase/time-delay sub-arraying. Cardone, L., "Ultra-Wideband Microwave Beamforming Technique," Microwave Journal, April 1985, p 121–128 gives an example of the discrete beam position technique with optical fibers in an optically coherent BFN (beamforming network). He does not include the switching technique for electronically selecting among the plurality of discrete antenna beams and we are not yet able to maintain the necessary optical tolerances for the optically coherent BFN. The second electronic concept for avoiding phase-only steering is to use the hybrid phase/time-delay steering wherein the phase steering is used within a sub-array whose size is limited by bandwidth and to use time-delay steering among the subarrays to maintain the sub-array bandwidth over the physically larger array. Ng, W., Walston, A. A., Tangonan, G. L., Lee, J. J., Newberg, I. L., & Bernstein, N., "The First Demonstration of an Optically Steered Microwave Phased Array Antenna Using True-Time-Delay," J. of Lightwave Technology, Vol. 9, No.9, p 1124–1131, September 1991 implement this concept using a switch with large numbers of active devices per unit shifter. Subarray systems with hybrid phase/time-delay scanning off broadside fall subject to large gains losses and higher sidelobes as bandwidth increases, scan angle increases, or beamwidth decreases, according to Tang, R., "Survey of Time-Delay Beam Steering Techniques," Phased Array Antennas, Oliner, Arthur A., and Knittel, George H., Editors, Artech House, Inc., Dedham, Mass. 1972. p 254–260.

The required time shifter is physically not significantly different from recent embodiments of a phase shifter used in microstrip circuits. A preferred microstrip method of implementing a microwave phase shifter is to use diode switched passive delay lines, potentially yielding the differential time delay which is necessary for wideband beam steering. Typically in order to reduce cost of an expensive component, the steering element is designed to be multiply reused. The beam steering computer calculates the phase required for a single specific frequency to determine which delay lines to select by switching. The multiple reuse is accomplished by the application of modulo $2\pi$ radian arithmetic which allows the computer to select a delay line which is shorter than the true time delay length by an integral number Of wavelengths for a specific single frequency. This re-used switched delay line shifter introduces a frequency dispersion without the advantage of squint-free beamsteering of the antenna beam.

Cost is the driver for requiting multiple reuse of components of a steering element of a phased array. The first reuse reason is the potential of component state reuse. The phase shifter accomplishes phase state reuse by modulo $2\pi$ radian arithmetic. Many phase states can be reused on a single frequency basis. This means that for identical shifters, many more true time delay states are required than for identical phase shifting states. The second reuse reason is that microwave delay space is a precious resource according to Thompson, James D., U.S. Pat. No. 5,012,254, Apr. 30, 1991. If each array element requires its own shifting module to be located near or within the aperture of the antenna and a close spaced grating-lobe-free aperture is desired, significant aperture depth is required, often making conformal or tiled antenna structures dimensionally not possible without significant performance compromise. The third reuse reason is that if $N^2$ phase/time shifters of an N by N element array are required, this is a significant total cost. Making all $N^2$ phase/time shifters identical may make an affordable unit production cost. The fourth reuse reason is for the special cases of circular and conformal phased array beam steering. "The rotation of tapered excitations usually requires control of both amplitude and phase and this represents one of the limitations of beam cophasel systems due to the cost and complexity of Scanning", according to Davies, D. E. N., "Circular Arrays," The Handbook of Antenna Design, A. W. Rudge, K. Milne, A. D. Olver, P. Knight, Editors, Chapter 12, Peter Perigrinius, Ltd., 1986, p 992–1023. The classic choices are to scan circular ting arrays using weighted phase modes or to scan subarrays using phase shifters within a Butler matrix. Unfortunately, extremely wideband true phase shifters even more difficult to fabricate than extremely wideband than true time delay shifters and typically the phase shifter methods do not always provide for independent amplitude taper control.

In view of the above a need is apparent for an improved, preferable optical, squint-free beamsteering device for a phase array antenna. It is also imperative for extremely wideband use, that squint-free beamsteering must be implemented in a manner which dramatically reduces the the number of time shifters required. Further, if monopulse angle tracking schemes are to be used, the extreme change in the antenna beamwidth must be suppressed to obtain a frequency independent monopulse indicated spatial angle.

It is therefore an object of this invention to provide a frequency independent beamsteering and beamforming network that: (i) provides increased microwave isolation, reduced volume, weight, and part count of the beamsteering elements, (2) uses optical time delay lines to minimize space and weight resources, (3) uses low loss receiving optical beamforming networks, (4) reuses the time delay shifter for additional array elements rather than reuses the delay length in a non-frequency independent manner, (5) provides simplified computation of beamsteering and beam shaping commands for conformal arrays, (6) provides reduced number of commanded states to achieve 2-dimensional beamsteering, (7) uses squint-free beamsteering of the antenna beam center, (8) uses a unique antenna true time delay antenna scanning coherence center, (9) uses simultaneous multiple antenna beams, (10) provides a mechanism for minimizing beamwidth variation with frequency, (11) provides extremely wideband monopulse angle sensing, and (12) provides microsecond beamsteering.

SUMMARY OF THE INVENTION

In a broad aspect the present invention comprises a multi-throw electronic switch for a fiber optical cable network. The multi-throw electronic switch includes a bulk media optical deflector angularly controllable by selectable electronic steering signals. The bulk media optical deflector has a first side for receiving an input optical signal, the input optical signal being collimated to a degree necessary for Bragg deflection and for being reimagable. A second side of the bulk media optical deflector transmits at least one collimated electronically selectable output optical signal. A first positioning means provides precision positioning of a primary optical fiber positioned near the first side of the bulk media optical deflector. A collimator is positioned between the first positioning means and the first side of the bulk media optical deflector for receiving the input optical signal, collimating the input optical signal and directing the input optical signal to the first side of the bulk media optical deflector. Second positioning means provides precision positioning of a column of a plurality of secondary optical fibers positioned near the second side of the bulk media optical deflector. An imager is positioned between the second side of the bulk media optical deflector and the second positioning means for receiving output optical signal from the bulk media optical deflector, imaging the output signal and directing the output optical signal to the secondary optical fibers.

The true time delay (TTD) shifter includes a back-to-back pair of the multi-throw electronic switches sandwiching a column of a plurality of beamsteering optical fiber delay lines on the multi-throw ends of the multi-throw switches. A common signal source provides the selectable electronic steering signals, such that selecting a desired electronic steering signal provides selection of a desired set of the beamsteering optical fiber delay lines. The signal source may be an antenna array steering command for one or more simultaneous directions in space.

For squint-fee steering of an antenna array for a plurality of directions in space, the TTD shifter for each antenna array element must have its unique column of a plurality of beamsteering optical fiber delay lines. If the squint-free beamsteering optical fiber delay lines for each antenna array element are properly ordered, the same selectable electronic steering signals can be used for all TTD shifters of the electronic steered antenna array. For this reason bulk media optical deflectors switches used in the true time delay shifter are ideally suited for simultaneously steering multiple array elements in multiple simultaneous directions in space.

Also, in a broad aspect, the present invention comprises a multiple element, multi-throw electronic switch for a fiber optical cable network. The multiple element, multi-throw electronic switch includes a bulk media optical deflector angularly controllable by selectable electronic steering signals. The bulk media optical deflector has a first side for receiving a row of a plurality input optical signals, the plurality input optical signals being collimated to a degree necessary for Bragg deflection and for being re-imagable. A second side of the bulk media optical deflector transmits at least one collimated electronically selectable output optical signal. A first positioning means provides precision positioning of the row of primary optical fibers positioned near the first side of the bulk media optical deflector. A collimator is positioned between the first positioning means and the first side of the bulk media optical deflector for receiving the plurality of input optical signals, collimating the plurality of input optical signals and directing the plurality of input optical signals to the first side of the bulk media optical deflector. Second positioning means provides precision positioning a row of a plurality of a column of a plurality of secondary optical fibers positioned near the second side of the bulk media optical deflector. An imager or converging lens is positioned between the second side of the bulk media optical deflector and the second positioning means for receiving the row of a plurality of columns of output optical signals from the bulk media optical deflector, imaging the plurality of output optical signals and directing the plurality of output optical signals to the row of the plurality of columns of the plurality of secondary optical fibers.

The multiple element, true time delay (TTD) shifter includes a back-to-back pair of the multi-throw electronic switches sandwiching a 2-dimensional plurality of beamsteering optical fiber delay lines on the multi-throw ends of the multi-throw electronic switches. A common signal source provides the selectable electronic steering signals, such that selecting a desired electronic steering signal provides selection of a desired set of the beamsteering optical fiber delay lines for one or more simultaneous directions in space.

To beamsteer a linear array of antenna elements only one steering direction cosine need be used when the desired antenna scanning coherence center lies anywhere collinear with the array element coherence centers. For squint-free beamsteering a planar array in 2-dimensional space, two steering direction cosines are required. This essentially squares the number of states required for true time delay shifters. Unless the geometry of the array lattice is exploited by distributed beamsteering and combining, this can lead to excessive part counts.

Distributed beamsteering is performed by selecting linear subarrays from the composite array, providing the single steering direction cosine for that linear subarray, using in the first set of TTD shifters rows of a plurality of columns each with a plurality of beamsteering optical fiber delay lines with a specified antenna scanning center. The beamsteered linear array can be combined in a distributed beamforming network to become a subarray with the specified antenna scanning center. If the specified antenna scanning centers for all the linear subarrays coincide, no further beamsteering is required. If the specified antenna scanning centers are all collinear, one more beamsteering must be performed, providing final steering direction cosine for the array of subarrays, using in the second TTD shifter rows of a plurality of columns of a plurality of beamsteering optical fiber delay lines with a specified antenna scanning center collinear with the subarray scanning center.

BRIEF DESCRIPTION OF THE DRAWINGS

The same elements or parts throughout the figures of the drawings are designated by the same reference characters while similar components bear a prime designation.

DETAILED DESCRIPTION OF THE INVENTION

Figure 1:
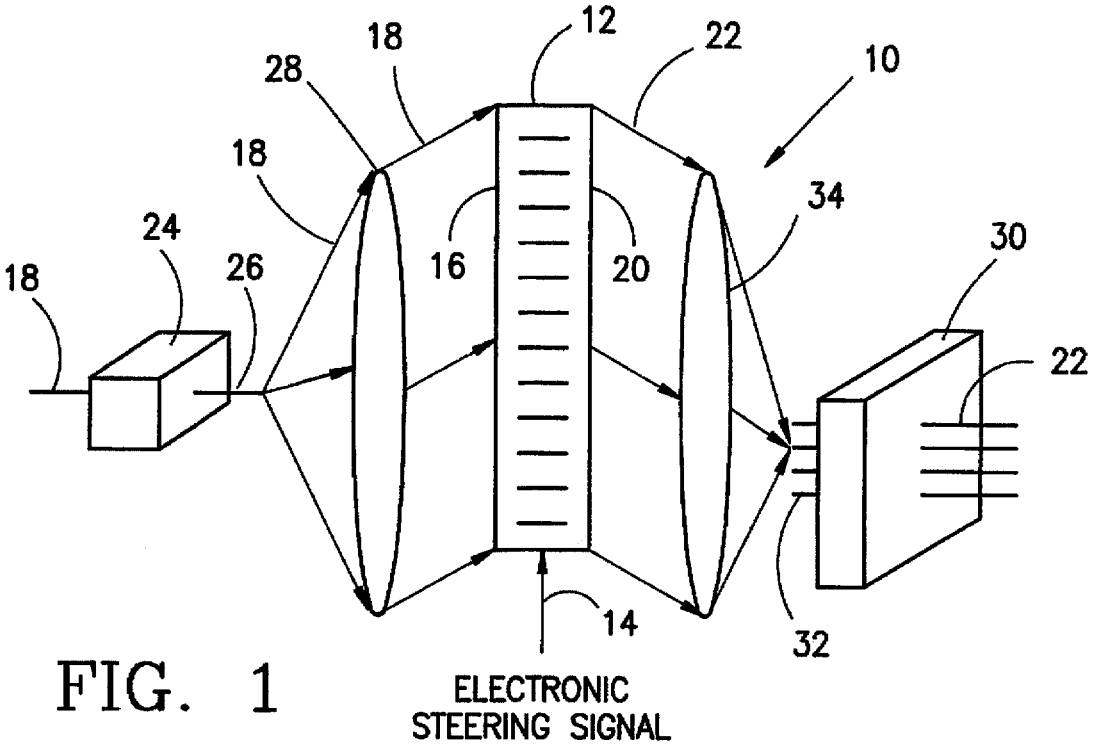
FIG. 1 is a schematic illustration of a multi-throw electronic switch for a fiber optical cable network accordance with the principles of the present invention.

Referring now to the drawings and the characters of reference marked thereon, FIG. 1 illustrates a multi-throw electronic switch, designated generally as 10. The multi-throw electronic switch 10 includes a bulk media optical deflector 12 angularly controllable by selectable electronic steering signals 14. The bulk media optical deflector 12 has a first side 16 for receiving an input-optical signal 18, the input signal being collimated to a degree necessary for Bragg deflection and for being re-imagable. A second side 20 of the bulk media optical deflector 12 transmits at least one collimated electronically selectable output optical signal 22. A first positioning means 24 provides precision positioning of a primary optical fiber 26 initially carrying the input optical signal 18, positioned near the first side 16 of the bulk media optical deflector 12. A collimator 28 is positioned between the first positioning means 24 and the first side 16 of the bulk media optical deflector 12 for receiving the input optical signal 18, collimating the input optical signal 18 and directing the input optical signal 18 to the first side 16 of the bulk media optical deflector 12. Second positioning means 30 provides precision positioning of a column of a plurality of secondary optical fibers 32 positioned near the second side 20 of the bulk media optical deflector 12. An imager or converging lens 34 is positioned between the second side 20 of the bulk media optical deflector 12 and the second positioning means 30 for receiving output optical signal 22 from the bulk media optical deflector, imaging the output signal and directing the output optical signal 22 to the secondary optical fibers 32. A signal source provides the selectable electronic steering signals 14, such that selecting at least one desired electronic steering signal provides selection of a desired set within the column of the secondary optical fibers 32 for transmission of the input optical signal 18 to the output optical signals 22. For a Bragg cell bulk media optical deflector 12, the signal source may provide a plurality of selectable electronic steering signals 14, such that magnitudes of the plurality of output optical signals 22 are selectable.

Figure 2:
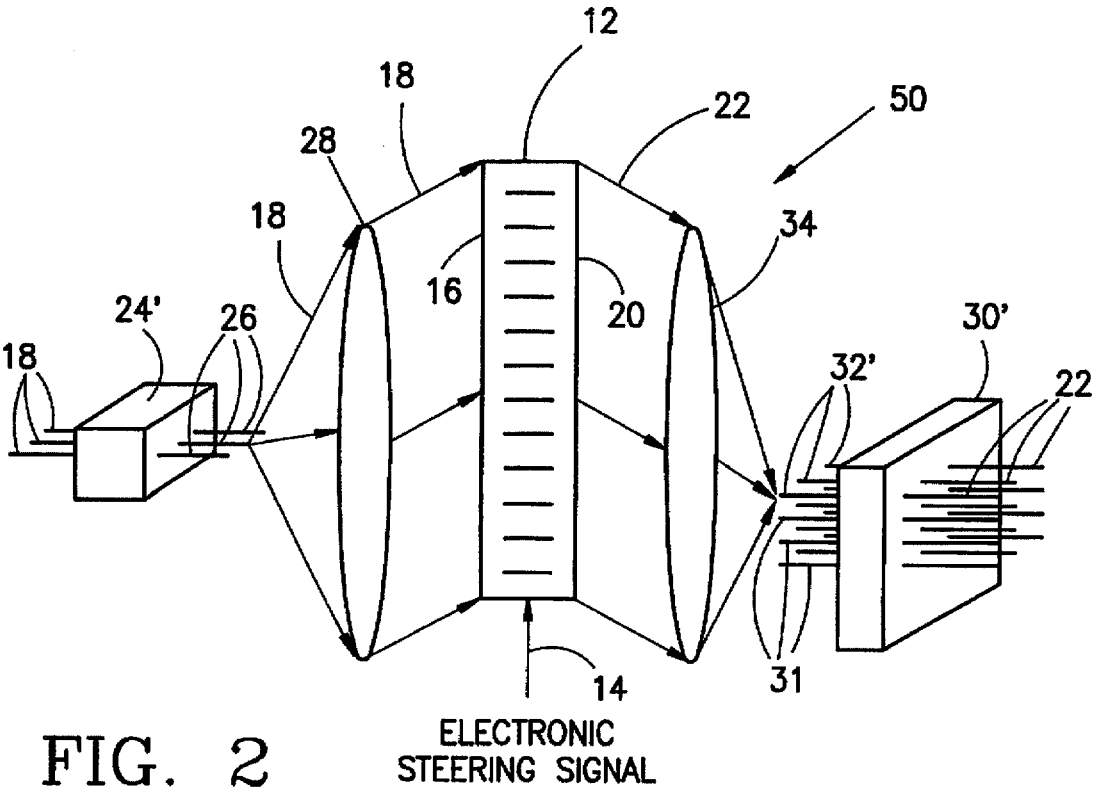
FIG. 2 is a schematic illustration of a multiple element, multi-throw electronic switch for a fiber optical cable network in accordance with the principles of the present invention.

FIG. 2 illustrates a multiple element, multi-throw electronic switch, designated generally as 50. The multi-throw electronic switch 10 includes a bulk media optical deflector 12 angularly controllable by selectable electronic steering signals 14. The bulk media optical deflector 12 has a first side 16 for receiving a plurality of input optical signals 18 aligned in a row, the input signals being collimated to a degree necessary for Bragg deflection and for being re-imagable. A second side 20 of the bulk media optical deflector 12 transmits at least one collimated electronically selectable output optical signal for each of the input optical signals 18. A first positioning means 24' provides precision positioning of the row of primary optical fibers 26 initially carrying the plurality of input optical signals 18, positioned near the first side 16 of the bulk media optical deflector 12. A collimator 28 is positioned between the first positioning means 24' and the first side 16 of the bulk media optical deflector 12 for receiving the plurality of input optical signals, collimating the plurality of input optical signals 18 and directing the plurality of input optical signals 18 to the first side 16 of the bulk media optical deflector 12. Second positioning means 30' provides for each of the input optical signals 18, a precision positioning of a column of a plurality of secondary optical fibers 32 positioned near the second side 20 of the bulk media optical deflector 12. The plurality of secondary optical fibers are also precision positioned as rows of in a manner similar to the primary optical fibers 26 by the first positioning means 24'. An imager or converging lens 34 is positioned between the second side 20 of the bulk media optical deflector 12 and the second positioning means 30' for receiving the plurality of output optical signals 22 from the bulk media optical deflector, imaging the plurality of output optical signals 22 and directing the plurality of output optical signals 22 to the rows 31 and columns of the plurality of secondary optical fibers 32'. A signal source provides the row selectable electronic steering signals 14, such that selecting a desired electronic steering signal provides selection of a desired set of rows 31 of the columns of the plurality of secondary optical fibers 32'. As in FIG. 1, for a Bragg cell bulk media optical deflector 12, the signal source may select the magnitudes of multiple rows of output optical signals 22.

Figure 3:
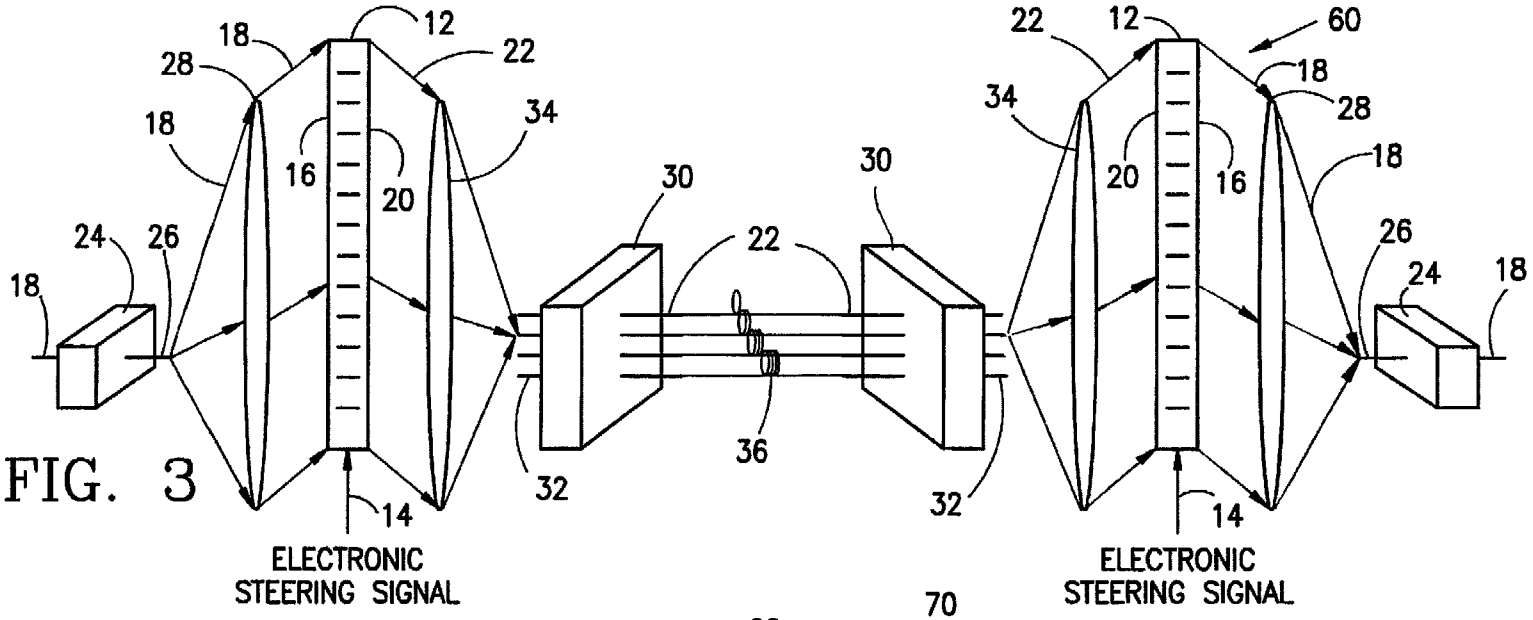
FIG. 3 is a schematic illustration of a true time delay shifter for beamsteering of a single array element in accordance with the principles of the present invention.

Referring now to FIG. 3, an electronic true time delay shifter, one of a plurality required for beamsteering, is illustrated, designated generally as 60. This consists a pair of back-to-back multi-throw electronic switches 10 sandwiching a column of beamsteering optical fiber delay lines 36. The insertion losses of the multi-throw electronic switch 10 in the reverse direction can be similar to the forward direction for solitary selectable electronic steering signals 14 with proper attention to polarization. Each beamsteering optical fiber delay line of the column 36 may be fabricated with a unique length to provide the input optical signal 18 with a plurality of unique time delays selectable via the electronic steering signal 14.

Figure 4:
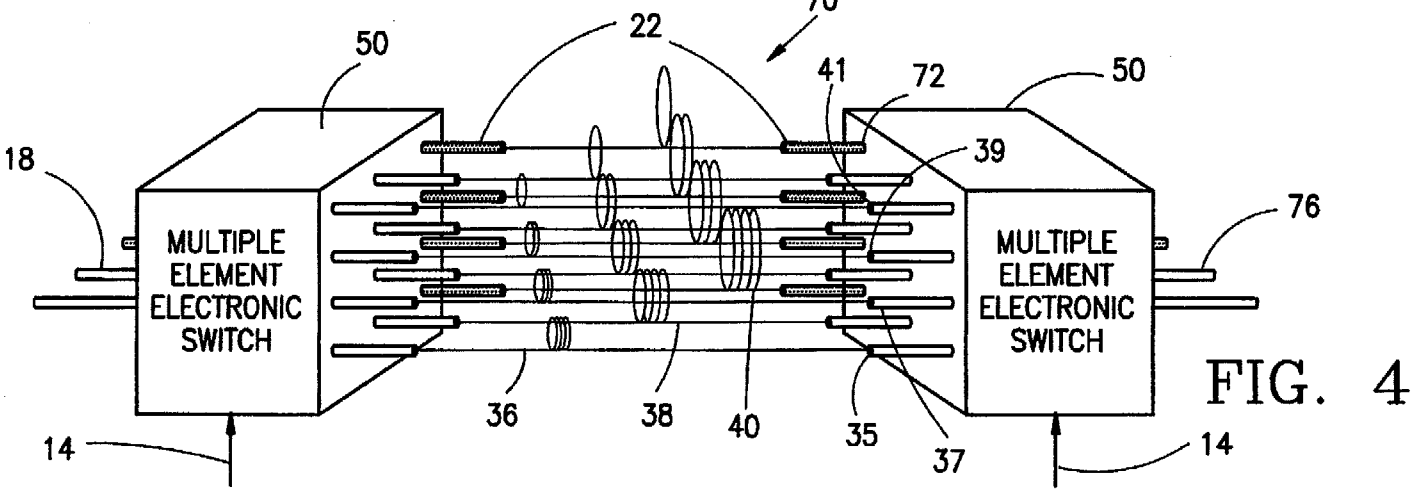
FIG. 4 is a schematic illustration of a multiple element true time delay shifter for beamsteering a linear array in accordance with the principles of the present invention.

FIG. 4 illustrates an electronic multiple element photonic true time delay shifter suited for beamsteering, designated generally as 70. In the manner of FIG. 3, there is a pair of back-to-back multiple element, multi-throw electronic switches 50 sandwiching columns of a plurality of beamsteering optical fiber delay lines 36, 38, 40, or more. The first electronic switch 50 receives a plurality of input optical signals 18 and the second electronic switch 50 directing the plurality of beamsteered optical signals 76. Each fiber optic cable delay line within the plurality of columns of beamsteering optical fiber delay lines 36, 38, 40, or more is fabricated with a unique length to provide a plurality of beamsteered optical signals 76, selectable via the electronic steering signal 14.

Figure 5:
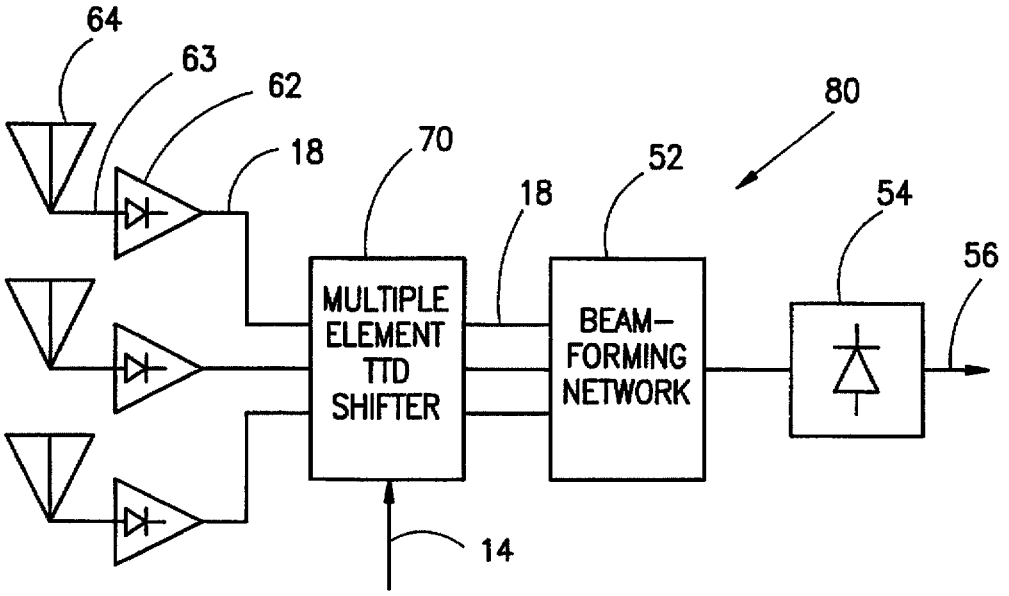
FIG. 5 is a block diagram illustrating the use of the true time delay shifter in an electronically steered microwave or millimeter wave linear array antenna.

FIG. 5 is a receiving block diagram for an antenna linear array beamsteered by a photonic true time delay shifter, designated generally as 80. The electronic multiple element true time delay shifter 70 of FIG. 4 uses columns of plurality of beamsteering optical fiber delay lines 36, 38, 40, or more to permit squint-free microwave beamsteering of the collinear output microwave signals 63 of the linear array elements 64. Interfacing the output microwave signals of the antenna linear array elements 64 to input optical signals to the multiple element photonic TTD shifter 70, are the laser diode transmitters 62, which are an integration of microwave preamplifiers and directly modulated laser diodes. On the output end of the photonic TTD shifter 70 of FIG. 4, a plurality of output optical signals 18 are appropriately beamsteered with a common antenna scanning coherence center and must now must be now microwave coherently combined. The customary nomenclature for this function is a beamforming network. The preferred embodiment is a singlemode to multimode optical beamforming network 52 followed by a down-converting receiver 54, performing microwave detection and preamplification. The more traditional embodiment. performs a plurality of microwave detection followed by wideband microwave combiners. The optical combining must be microwave coherent, but for receiving electronic steered array, it is desirable to be optically incoherently combined in order not to be subject to optical tolerances.

Figure 6:
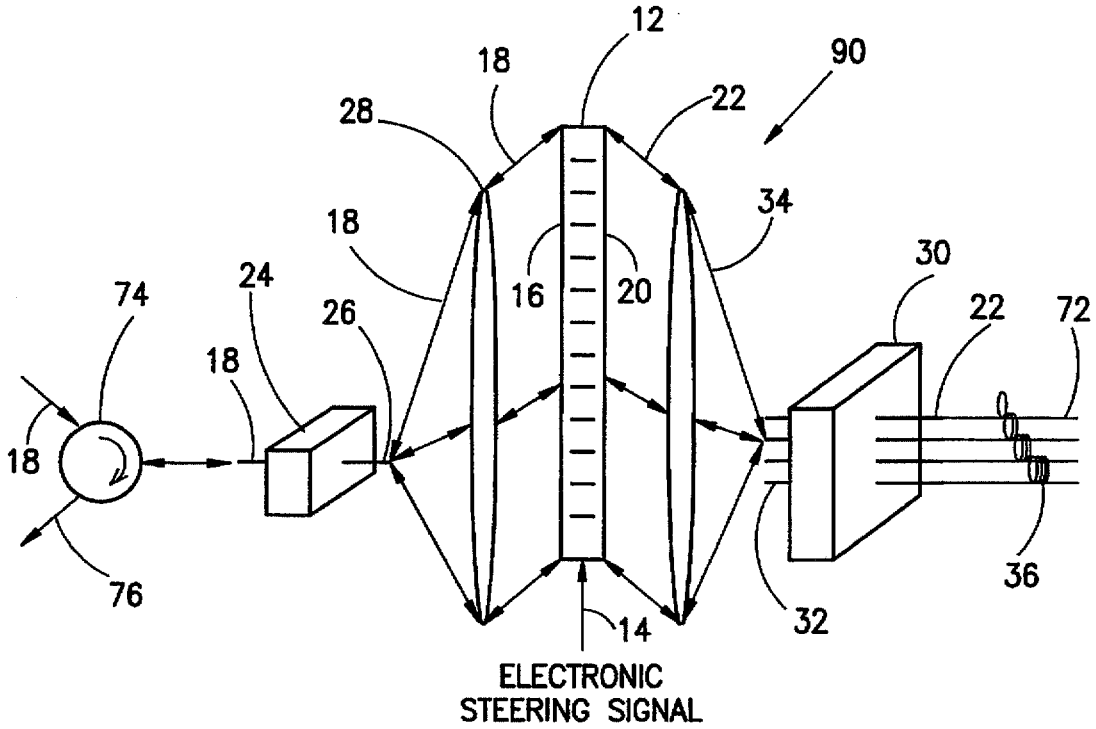
FIG. 6 is a schematic illustration of a reflecting, re-entrant TTD shifter in accordance with the principles of the present invention.

FIG. 6 illustrates the reflecting, re-entrant time delay shifter, one of a plurality required for beamsteering, designated generally as 90. For this true time delay shifter, only one multi-throw electronic switch 10 or multiple element, multi-throw electronic switch 50 is required. After at least one input optical signal 18 passes through the multi-throw electronic switch and into the delay lines 36', the input optical signal is reflected from the highly reflecting fiber optic cable ends 72. There are numerous processes for obtaining this high reflectivity. The reflected input optical signal re-enters the multi-throw electronic switch to be re-imaged on the primary optical fiber 26 in the first positioning means 24. There is an optical circulator 74 on the primary optical fiber 26 serving to separate the input optical signal 18 from the beamsteered optical signal 76.

Figure 7:
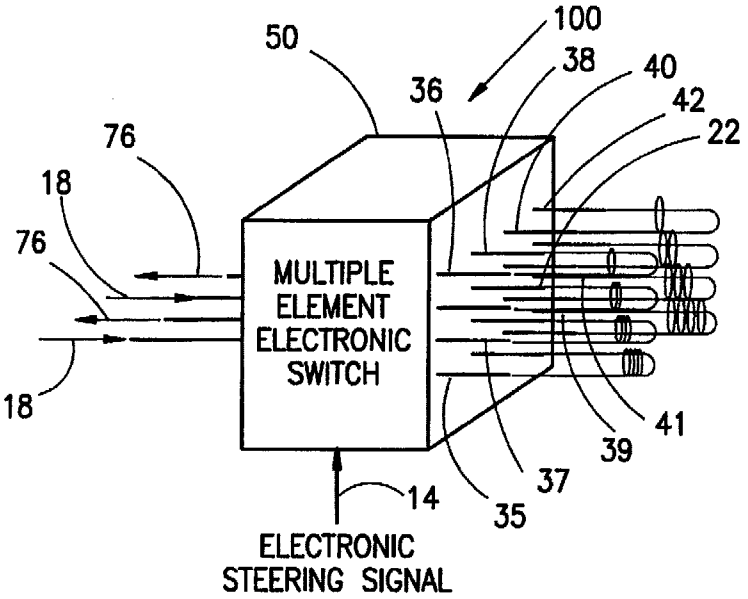
FIG. 7 is a schematic illustration of a multiple element loop-back fiber, re-entrant TTD shifter for beamsteering a linear array in accordance with the principles of the present invention.

FIG. 7 illustrates a multiple element fiber loop-back, re-entrant true time delay shifter suited for beamsteering, designated generally as 100. In this TTD shifter, the first positioning means 24' of FIG. 4, holds a plurality of input optical signals 18 and a plurality of output optical signals 76. In this loop-back, re-entrant TTD shifter 100, the plurality of columns of beamsteering optical fiber delay lines 36, 40, or more optical fibers from the second positioning means 30' of FIG. 4 are looped back within the same plurality of rows 35, 37, 39, 41, or more to the plurality of columns 38, 42, or more of optical fibers in the second positioning means 30'. A signal source provides the row selectable electronic steering signals 14, such that the columns of beamsteering optical fiber delay lines 36, 40, or more optical fibers loop-back to the columns 38, 42, or more of optical fibers to propagate beamsteered optical signals 76.

Figure 8:
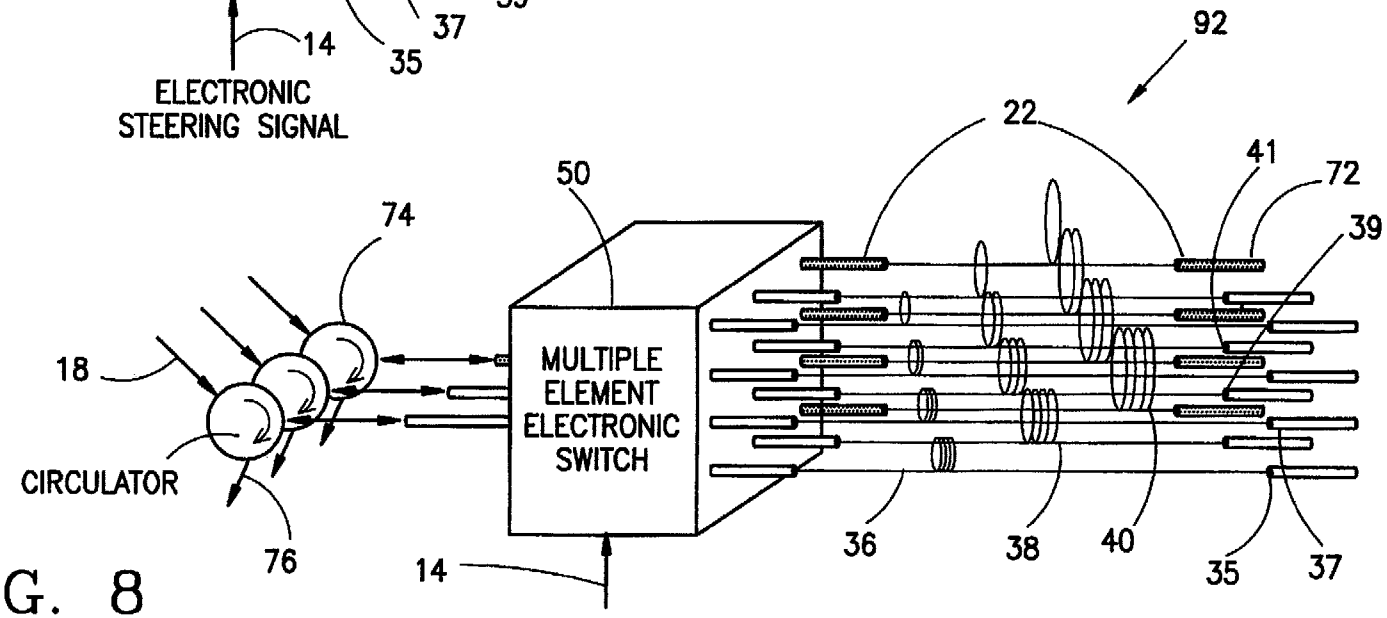
FIG. 8 is a schematic illustration of a reflecting, re-entrant multiple element true time delay shifter for beamsteering a linear array in accordance with the principles of the present invention.

FIG. 8 illustrates the reflecting, re-entrant TTD shifter suited for beamsteering, designated generally as 92. For this TTD shifter 92, only one multiple element, multi-throw electronic switch 50 is required. A plurality of input optical signals 18 pass through the circulators 74 to the multi-throw electronic switch 50. A signal source provides the row selectable electronic steering signals 14, such that selecting a desired electronic steering signal provides selection of a desired set of rows 37, 39, 41 or more of the plurality of columns of beamsteering optical fiber delay lines 36, 38, 40, or more optical fibers. The input optical signal 18 to the highly reflecting fiber optic cable ends 72 of the beamsteering optical fiber delay lines 36, 38, 40, or more. There are numerous processes for obtaining this high reflectivity. The reflected input optical signal 18 re-enters the multi-throw electronic switch 50 to propagate to plurality of optical circulators 74 which separate the plurality input optical signals 18 from the plurality of beamsteered optical signals 76.

Figure 9:
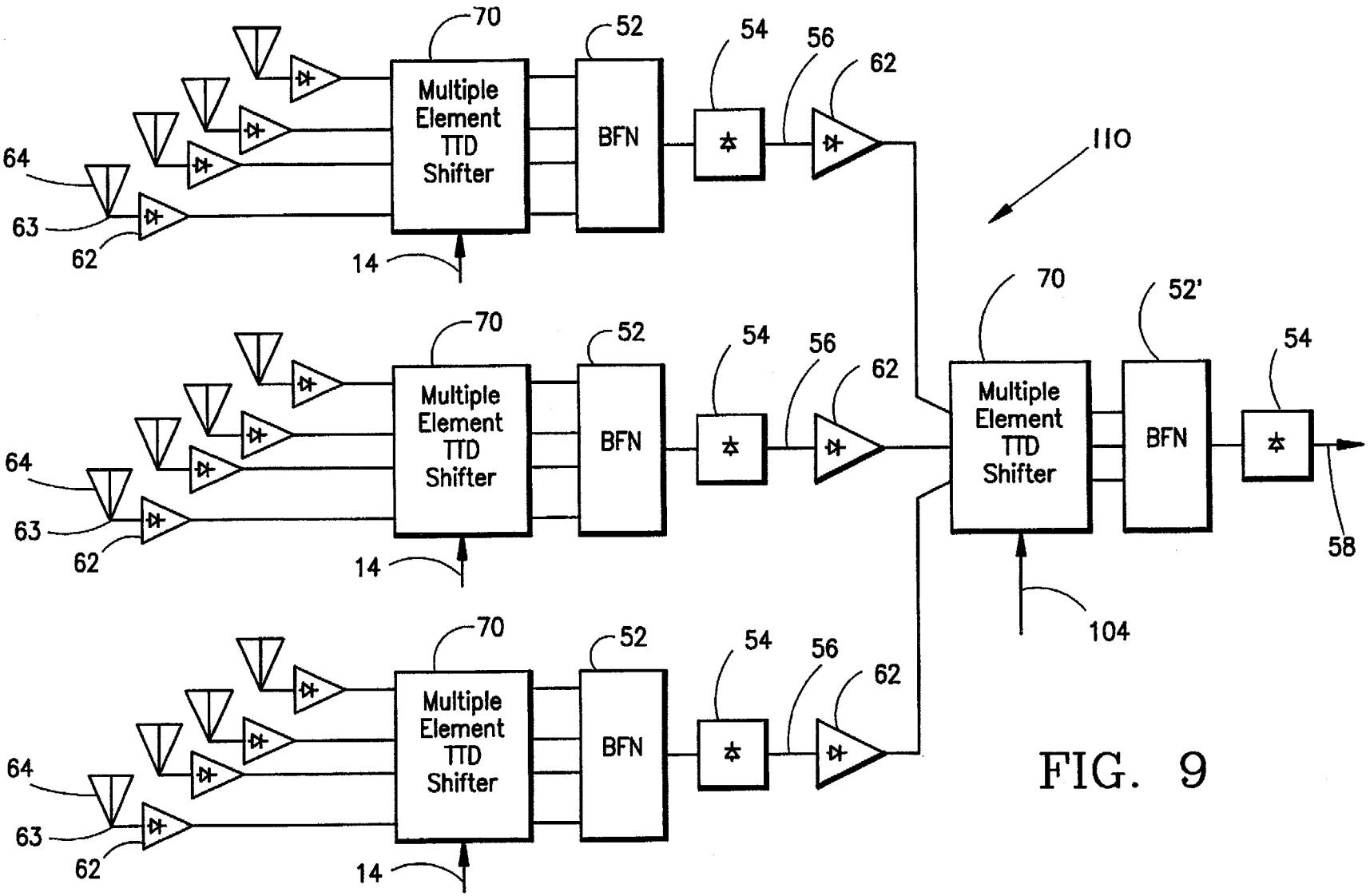
FIG. 9 is a block diagram of a distributed beamforming network with distributed beamsteering using multiple element true time delay shifters for a 2-dimensional electronic scanned array in accordance with the principles of the present invention.

FIG. 9 is a block diagram of a distributed TTD beamsteered electronic antenna array, designated generally as 110. The electronic antenna array need not be a linear array, but can be a planar array or a conformal array. For some geometries like a planar arrays is sometime more efficient to beamsteer by rows and columns. In these cases, first level of beamsteering for the distributed TTD beamsteered composite array 110 uses a plurality of linear arrays each beamsteered by a photonic TTD shifter 80 as in FIG. 5. This first level of beamsteering is performed in accordance with the first level set of steering direction cosines. In this first level, the first level beamsteering optical delay lines 36, 38, or more within each first level multiple element TTD shifter 70 are selected such that the antenna scanning coherence centers of the first level subarray output microwave signals 56 are are collinear. In the next level of distributed beamsteering, the first level beamsteered collinear output microwave signals 56 are treated just like the nonsteered collinear output microwave signals 63 of the linear array elements 64 in FIG. 4. Each of these first level beamsteered collinear output microwave signals 56 and the second level multiple element TTD shifter 70 are interfaced by laser diode transmitters 62. The second level multiple element photonic TTD shifter 70 receives the second level electronic steering signal 104 with the second level direction cosines for the linear array of subarrays. The second level beamsteering optical delay lines 36, 38, or more within the second level multiple element TTD Shifter 70 are selected such that the second level antenna scanning coherence centers of the subarray of first and second level beamsteered output microwave signals 58 are collinear with any other linear array of subarrays. When only a single antenna scanning coherence center remains, no further level of distributed beamsteering is required.

Obviously, many modifications and variations of the present invention are possible in light of the above teachings. It is therefore to be understood that, within the scope of the appended claims, the invention may be practiced otherwise than specifically described.

What is claimed and desired to be secured by Letters Patent of the United States is:

1. A multi-throw electronic switch for a fiber optical cable network, comprising:

a) a bulk media optical deflector comprising a Bragg cell angularly controllable by selectable electronic steering signals, said bulk media optical deflector having a first side for receiving an input optical signal, said input signal being collimated to a degree necessary for Bragg deflection and for being re-imagable, and a second side for transmitting at least one collimated electronically selectable output optical signal;

b) first positioning means for precision positioning of a primary optical fiber positioned near said first side of said bulk media optical deflector;

c) collimating means positioned between said first positioning means and said first side of said bulk media optical deflector for receiving said input optical signal, collimating said input optical signal and directing said input optical signal to said first side of said bulk media optical deflector;, d) second positioning means for precision positioning of a column of a plurality of secondary optical fibers positioned near said second side of said bulk media optical deflector;

e) imaging means positioned between said second side of said bulk media optical deflector and said second positioning means for receiving said at least one output optical signal from said bulk media optical deflector, imaging said output signal and directing said output optical signal to said secondary optical fibers; and, f) means for providing said selectable electronic steering signals, wherein selecting a desired electronic steering signal provides selection of a desired set of said second optical fibers.

2. A multi-element, multi-throw electronic switch for a fiber optical cable network, comprising:

a single bulk media optical deflector angularly controllable by selectable electronic steering signals, said bulk media optical deflector having a first side for receiving a plurality of input optical signals, said plurality of input signals being collimated to a degree necessary for Bragg deflection and for being re-imagable, and a second side for transmitting at least one collimated electronically selectable output optical signal;

b) first positioning means for precision positioning of a plurality of primary optical fibers positioned near said first side of said bulk media optical deflector;

c) collimating means positioned between said first positioning means and said first side of said bulk media optical deflector for receiving said plurality of input optical signals, collimating said plurality of input optical signals and directing said plurality of input optical signals to said first side of said bulk media optical deflector, d) second positioning means for precision positioning of a plurality of columns of a plurality of secondary optical fibers positioned near said second side of said bulk media optical deflector;

e) imaging means positioned between said second side of said bulk media optical deflector and said second positioning means for receiving said at least one output optical signal from said bulk media optical deflector, imaging said output signal and directing said output optical signal to said secondary optical fibers; and, f) means for providing said selectable electronic steering signals, wherein selecting a desired electronic steering signal provides selection of a desired set of said secondary optical fibers.

3. A true time-delay (TTD) shifter, comprising:

a pair of back-to-back multi-throw electronic switches, each switch comprising:

a) a single bulk media optical deflector angularly controllable by selectable electronic steering signals, said bulk media optical deflector having a first side for receiving an input optical signal, said input signal being collimated to a degree necessary for Bragg deflection and for being re-imagable, and a second side for transmitting at least one collimated electronically selectable output optical signal;

b) first positioning means for precision positioning of a primary optical fiber positioned near said first side of said bulk media optical deflector;

c) collimating means positioned between said first positioning means and said first side of said bulk media optical deflector for receiving said input optical signal, collimating said input optical signals and directing said input optical signals to said first side of said bulk media optical deflector;

d) second positioning means for precision positioning of a column of a plurality of secondary optical fibers positioned near said second side of said bulk media optical deflector;

e) imaging means positioned between said second side of said bulk media optical deflector and said second positioning means for receiving said at least one output optical signal from said bulk media optical deflector, imaging said output signal and directing said output optical signal to said secondary optical fibers; and, f) means for providing said selectable electronic steering signals, wherein selecting a desired electronic steering signal provides selection of a desired set of said secondary optical fibers; and beamsteering optical fiber delay lines for connecting said switches, said delay lines being connected on each said column of said plurality of secondary optical fibers.

4. A multi-element, true time-delay (TTD) shifter, comprising:

a pair of back-to-back, multi-element multi-throw electronic switches, each switch comprising:

a) a single bulk media optical deflector angularly controllable by selectable electronic steering signals, said bulk media optical deflector having a first side for receiving an input optical signal, said input signal being collimated to a degree necessary for Bragg deflection and for being re-imagable, and a second side for transmitting at least one collimated electronically selectable output optical signal;

b) first positioning means for precision positioning of a row of a plurality of primary optical fibers positioned near said first side of said bulk media optical deflector;

c) collimating means positioned between said first positioning means and said first side of said bulk media optical deflector for receiving said plurality of input optical signals, collimating said plurality of input optical signals and directing said plurality of input optical signals to said first side of said bulk media optical deflector;

d) second positioning means for precision positioning of a plurality of columns of a plurality of secondary optical fibers positioned near said second side of said bulk media optical deflector;

e) imaging means positioned between said second side of said bulk media optical deflector and said second positioning means for receiving said at least one output optical signal from said bulk media optical deflector, imaging said output signal and directing said output optical signal to said secondary optical fibers; and, f) means for providing said selectable electronic steering signals, wherein selecting a desired electronic steering signal provides selection of a desired set of said secondary optical fibers; and a plurality of columns, each having a plurality of beamsteering optical fiber delay lines, each said delay line being connected on a first end to an associated secondary optical fibers of a first of said pair of electronic multi-throw switches and being connected on a second end to associated secondary optical fibers of a second of said pair of electronic multi-throw switches.

5. The multiple element TTD shifter of claim 4, wherein a row of said plurality of columns of a plurality of beamsteering optical fiber delay lines, comprise the TTD control for a specific far field antenna beam pointing squint-free in 3-dimensional space.

6. The multiple element TTD shifter of claim 4, wherein a plurality of rows of said plurality of said columns, each having of a plurality of beamsteering optical fiber delay lines, comprise the TTD control for a plurality of far field antenna beams pointing squint-free in 3-dimensional space with a common antenna scanning coherence center.

7. A re-entrant true time-delay (TTD) shifter, comprising:

a multi-throw electronic switch comprising:

a) a bulk media optical deflector angularly controllable by selectable electronic steering signals, said bulk media optical deflector having a first side for receiving an input optical signal and transmitting an output signal, said input optical signal being collimated to a degree necessary for Bragg deflection and for being re-imagable and said output optical signal being collimated to a degree necessary for being re-imagable, and a second side for transmitting at least one collimated electronically selectable output optical signal and for receiving at least one input optical signal;

b) first positioning means for precision positioning of at least one primary optical fiber positioned near said first side of said bulk media optical deflector, said primary optical fiber guides at least one input optical signal and at least one output optical signal;

c) collimating and imaging means positioned between said first positioning means and said first side of said bulk media optical deflector for receiving said input optical signal from said first positioning means, collimating said input optical signals and directing said input optical signal to said first side of said bulk media optical deflector, and for receiving said at least one output optical signal from said bulk media optical deflector, imaging said output signal and directing said output optical signal to said primary optical fibers;

d) second positioning means for precision positioning of a column of a plurality of secondary optical fibers positioned near said second side of said bulk media optical deflector, said column of a plurality of secondary optical fibers guides at least one output optical signal and at least one input optical signal;

e) imaging and collimating means positioned between said second side of said bulk media optical deflector and said second positioning means for receiving said at least one output optical signal from said bulk media optical deflector, imaging said output signal and directing said output optical signal to said secondary optical fibers and for receiving said input optical signal from said second positioning means, collimating said input optical signals and directing said input optical signal to said second side of said bulk media optical deflector; and, f) means for providing said selectable electronic steering signals, wherein selecting a desired electronic steering signal provides selection of a desired set of said secondary optical fibers;

beamsteering optical fiber delay lines, said delay lines being connected on first ends thereof to said column of said plurality of secondary optical fibers, second ends of said delay lines having highly reflecting coatings formed thereon for reflecting and redirecting said input optical signal in the reverse direction back through the multi-throw electronic switch to the fibers in said first positioning means; and a circulator with at least three ports to separate said input optical signal from said output optical signal.

8. A loop-back true time-delay (TTD) shifter, comprising:

a multi-throw electronic switch comprising:

a) a bulk media optical deflector angularly controllable by selectable electronic steering signals, said bulk media optical deflector having a first side for receiving an input optical signal and transmitting an output signal, said input optical signal being collimated to a degree necessary for Bragg deflection and for being re-imagable and said output optical being collimated to a degree necessary for being re-imagable, and a second side for transmitting at least one collimated electronically selectable output optical signal and for receiving at least one input optical signal;

b) first positioning means for precision positioning a row of a plurality of primary optical fibers positioned near said first side of said bulk media optical deflector, said primary optical fibers guide at least one input optical signal and at least one output optical signal;

c) collimating and imaging means positioned between said first positioning means and said first side of said bulk media optical deflector for receiving said input optical signal from said first positioning means, collimating said input optical signals and directing said input optical signal to said first side of said bulk media optical deflector, and for receiving said at least one output optical signal from said bulk media optical deflector, imaging said output signal and directing said output optical signal to said primary optical fibers;

d) second positioning means for precision positioning a plurality of columns of a plurality of secondary optical fibers positioned near said second side of said bulk media optical deflector;

e) imaging and collimating means positioned between said second side of said bulk media optical deflector and said second positioning means for receiving said at least one output optical signal from said bulk media optical deflector, imaging said output signal and directing said output optical signal to said secondary optical fibers and for receiving said input optical signal from said second positioning means, collimating said input optical signals and directing said input optical signal to said second side of said bulk media optical deflector; and, f) means for providing said selectable electronic steering signals, wherein selecting a desired electronic steering signal provides selection of a desired set of said secondary optical fibers; and beamsteering optical fiber delay lines, said delay lines each being connected on first end to each said column of said plurality of secondary optical fibers guiding output optical signals; and each beamsteering optical fiber delay line being looped-back for the second end of said beamsteering optical fiber delay lines to be connected to said column of said plurality of secondary optical fibers in the second positioning means guiding input optical signals, redirecting said input optical signal in the reverse direction back through the multi-throw electronic switch to the fibers in said first positioning means; wherein, said output optical signal is propagated on a separate and distinct fiber in the first positioning means.

9. A re-entrant multiple element true time-delay (TTD) shifter, comprising:

a multiple element multi-throw electronic switch comprising:

a) a bulk media optical deflector angularly controllable by selectable electronic steering signals, said bulk media optical deflector having a first side for receiving a row of a plurality of input optical signals and transmitting an output signal, said row of a plurality of input optical signals being collimated to a degree necessary for Bragg deflection and for being re-imagable and said output optical signal being collimated to a degree necessary for being re-imagable, and a second side for transmitting at least one collimated electronically selectable output optical signal and for receiving a row of a plurality of input optical signals;

b) first positioning means for precision positioning of at row of a plurality of primary optical fibers positioned near said first side of said bulk media optical deflector, said a row of a plurality of primary optical fibers guide said row of said plurality of input optical signals and said row of said plurality of output optical signals;

c) collimating and imaging means positioned between said first positioning means and said first side of said bulk media optical deflector for receiving said input optical signal from said first positioning means, collimating said row of said plurality of input optical signals and directing said row of said plurality of input optical signals to said first side of said bulk media optical deflector, and for receiving said row of said plurality of output optical signals from said bulk media optical deflector, imaging said row of said plurality of output signals and directing said row of said plurality of output optical signal to said primary optical fibers;

d) second positioning means for precision positioning of a row of said plurality of columns of a plurality of secondary optical fibers positioned near said second side of said bulk media optical deflector, said row of said plurality of columns of a plurality of secondary optical fibers guides said row of said plurality of output optical signals and said row of said plurality of input optical signals;

e) imaging and collimating means positioned between said second side of said bulk media optical deflector and said second positioning means for receiving said row of said plurality of output optical signals from said bulk media optical deflector, imaging said row of said plurality of output signals and directing said row of said plurality of output optical signal to said secondary optical fibers and for receiving said row of said plurality of input optical signals from said second positioning means, collimating said row of said plurality of input optical signals and directing said row of said plurality of input optical signals to said second side of said bulk media optical deflector; and, f) means for providing said selectable electronic steering signals, wherein selecting a desired electronic steering signal provides selection of a desired set of said secondary optical fibers;

beamsteering optical fiber delay lines, said delay lines being connected on a first ends thereof to said row of said plurality of columns of said plurality of secondary optical fibers, second ends of said beamsteering optical delay lines having highly reflecting coatings formed thereon for reflecting and redirecting said row of said plurality of columns of said plurality of optical signals in the reverse direction back through the multiple element, multi-throw electronic switch to the fibers in said first positioning means; and a plurality of circulators with at least three ports to separate said row of said plurality of input optical signals from said row of said plurality of output optical signals.

* * * * *